US007527335B2

(12) United States Patent
Eberlein et al.

(10) Patent No.: US 7,527,335 B2
(45) Date of Patent: May 5, 2009

(54) SEATING UNIT WITH ADJUSTABLE COMPONENTS

(75) Inventors: David C. Eberlein, Hudsonville, MI (US); Kirt D. Martin, Alto, MI (US); James D. Houda, Byron Center, MI (US); David J. Dekker, Holland, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 11/711,346

(22) Filed: Feb. 27, 2007

(65) Prior Publication Data

US 2007/0200401 A1 Aug. 30, 2007

Related U.S. Application Data

(60) Provisional application No. 60/776,983, filed on Feb. 27, 2006.

(51) Int. Cl.
*A47C 31/02* (2006.01)
*A47C 31/11* (2006.01)

(52) U.S. Cl. ..... 297/218.4; 297/218.1; 297/218.3

(58) Field of Classification Search ..... 297/218.1, 297/218.3, 218.4
See application file for complete search history.

(56) References Cited

U.S. PATENT DOCUMENTS

| | | | | |
|---|---|---|---|---|
| 413,156 | A | 10/1889 | Wilkerson | |
| 455,168 | A | 6/1891 | Case | |
| 877,274 | A | 1/1908 | Weber | |
| 1,955,969 | A | 4/1934 | Marzolf | |
| 2,815,067 | A | 12/1957 | Richardson | |
| 2,817,548 | A | 12/1957 | Uthemann | |
| 3,224,807 | A | 12/1965 | Etal | |
| 3,434,756 | A | 3/1969 | Walkinshaw | |
| 3,490,808 | A | 1/1970 | Siegel | |
| 3,589,757 | A | 6/1971 | Mooney | |
| 3,614,085 | A | 10/1971 | Cunningham | |
| 3,722,950 | A * | 3/1973 | Harnick | 297/218.1 |
| 3,979,149 | A | 9/1976 | Vogel | |
| 4,029,279 | A | 6/1977 | Nakatani | |
| 4,043,592 | A | 8/1977 | Fries | |

(Continued)

FOREIGN PATENT DOCUMENTS

| | | | |
|---|---|---|---|
| CA | 2201253 | A1 | 9/1998 |

(Continued)

*Primary Examiner*—Rodney B. White
(74) *Attorney, Agent, or Firm*—Price, Heneveld, Cooper, DeWitt & Litton, LLP

(57) ABSTRACT

An armrest structure includes a tubular support, and an armrest having a tubular end telescopingly engaging the tubular support. A support plate engages bottom walls of the tubular support and the tubular end in a laminar arrangement. A clamping bolt slides through a top hole and into aligned holes in the laminar arrangement, with its head abutting the aligned holes. A clamping handle on a bottom of the bolt is rotatable between a clamping position tensioning the bolt to secure the arrangement, and a release position de-tensioning the bolt. By this arrangement, remaining walls of the tubular support and the tubular end are not deformed even when the clamp is clampingly pressing the adjacent sidewall sections together. An adjustable back with actuator handles at a lower edge of the back, and a seat assembly with fingers that retain an upholstery cover tight against concave areas are also shown.

19 Claims, 6 Drawing Sheets

U.S. PATENT DOCUMENTS 4,174,900 A 11/1979 Ina
4,185,936 A 1/1980 Takahashi
4,536,031 A 8/1985 Latone
4,596,484 A 6/1986 Nakatani
4,662,681 A 5/1987 Favaretto
4,662,682 A 5/1987 Maurel
4,707,025 A 11/1987 Rogers, Jr.
4,761,092 A 8/1988 Nakatani
4,815,688 A 3/1989 Wood
4,887,835 A 12/1989 Dallaire et al.
4,932,622 A 6/1990 Hayakawa
4,951,995 A 8/1990 Teppo et al.
5,007,678 A 4/1991 DeKraker
5,035,466 A 7/1991 Mathews et al.
5,143,422 A 9/1992 Althofer et al.
5,255,956 A 10/1993 Stevens
5,338,092 A * 8/1994 Wiltsey et al. ..... 297/218.4 X
5,338,133 A 8/1994 Tornero
5,393,125 A 2/1995 Watson et al.
5,419,617 A 5/1995 Schultz
5,439,267 A 8/1995 Peterson et al.
5,462,338 A 10/1995 Baumann
5,513,898 A 5/1996 Kanai et al.
5,529,373 A * 6/1996 Olson et al. ..... 297/218.4
5,582,460 A 12/1996 Schultz
5,586,809 A 12/1996 Szmadzinski
5,586,811 A 12/1996 Tornero
5,615,926 A 4/1997 Kanai et al.
5,630,650 A 5/1997 Peterson et al.
5,660,442 A 8/1997 Tornero
5,725,278 A 3/1998 Verbeek
5,769,497 A 6/1998 Tsai
5,839,784 A 11/1998 Breen
5,839,786 A 11/1998 Cvek
5,931,537 A 8/1999 Gollin et al.
5,938,285 A 8/1999 Verbeek
5,944,387 A 8/1999 Stumpf
5,975,639 A 11/1999 Wilson et al.
6,053,578 A 4/2000 Van Hekken et al.
6,076,892 A 6/2000 Van Hekken et al.
6,168,237 B1 1/2001 Lamart et al.
6,193,314 B1 2/2001 Chiang
6,209,963 B1 4/2001 Gust et al.
6,220,661 B1 * 4/2001 Peterson ..... 297/218.4
6,296,312 B1 10/2001 Congleton et al.
6,296,313 B1 10/2001 Wu
6,409,266 B1 6/2002 Chen
6,422,652 B1 7/2002 Roslund, Jr. et al.
6,508,509 B2 * 1/2003 Peterson ..... 297/218.4
6,536,723 B1 3/2003 Nakatani
6,554,364 B1 4/2003 Dammermann et al.
6,572,195 B1 6/2003 Lee
6,598,841 B2 7/2003 Erickson et al.
6,616,236 B1 9/2003 Su
6,619,746 B2 9/2003 Roslund, Jr. et al.
6,659,560 B1 12/2003 Chi
2004/0066080 A1 4/2004 Maier et al.

FOREIGN PATENT DOCUMENTS

DE 29517548 U 2/1996
DE 29620869 U 1/1997
DE EP1157637 A2 3/2001
DE EP1157637 A3 3/2001
DE 20303566 U 5/2003
GB 1481185 11/1974

* cited by examiner

SEATING UNIT WITH ADJUSTABLE COMPONENTS

CROSS-REFERENCE TO RELATED APPLICATION

This application claims the benefit of U.S. Provisional Patent Application No. 60/776,983, filed Feb. 27, 2006, the entire contents of which are incorporated herein by reference.

This application is also related to U.S. patent application No. 11/711,341, entitled "SEATING UNIT WITH ADJUSTABLE COMPONENTS," filed on Feb. 27, 2007, and U.S. patent application No. 11/711,349, entitled "SEATING UNIT WITH ADJUSTABLE COMPONENTS," filed on Feb. 27, 2007, the entire contents of each of which are incorporated herein by reference.

BACKGROUND OF THE INVENTION

The present invention relates to a seating unit with laterally adjustable armrests and vertically adjustable back, each configured to facilitate assembly and for convenient adjustment, but with hidden components to enhance aesthetics. The present invention also relates to a seat construction with underseat structure that facilitates assembly while maintaining a sleek, low-profile appearance and curvilinear lines for aesthetics. However, the present inventive concepts are not believed to be limited to only armrests, backs, and seats.

Modern consumers desire aesthetically-designed, competitively-priced, comfortable chairs. However, in order to be comfortable, consumers want adjustability so that the chairs can be adjusted for personal preference and body shape. A dilemma is that adjustable features add components, durability issues, and cost. Armrests, backs, and seats of office chairs offer particularly difficult challenges, since they are in high visibility locations and require styling elegance. Preferably, adjustment mechanisms must be secure, easy and intuitive to adjust, and have a minimum of components, but also must be visually appealing.

Unfortunately, features intended to increase aesthetics can also add to the cost. For example, a chair designer may want a relatively thin seat profile (when viewed from a side position) that emphasizes contours in the seat, such as a curved front edge that cascades forwardly and downwardly to support a seated user's legs. However, the curved front edge forms a concavity under the seat support which requires special treatment in order to pull upholstery tight against the concavity and not let the upholstery merely bridge in a linear fashion across the area of the concavity.

Thus, a system having the aforementioned advantages and solving the aforementioned problems is desired.

SUMMARY OF THE INVENTION

In one aspect of the present invention, a seating unit includes a base with a laterally-extending tubular support, and an armrest having a tubular end telescopingly engaging the tubular support, with the tubular end having a first sidewall adjacent a similarly-shaped sidewall of the tubular support. A clamp extends through the first sidewall and through the similarly-shaped sidewall and is configured to press the adjacent sidewalls together without crushing other walls of the tubular support and tubular end. By this arrangement, the remaining walls of the tubular support and the tubular end are not stressed in a way that will deform them even when the clamp is clampingly pressing the adjacent sidewalls together.

In another aspect of the present invention, an armrest support arrangement for a seating unit includes a laterally-extending tubular support, and an armrest having a laterally-extending end telescopingly engaging and positioned inside of the tubular support, where the laterally-extending end has a first sidewall adjacent a similarly-shaped sidewall of the tubular support. A support plate is positioned adjacent the adjacent sidewalls and within the tubular support, the support plate stiffening the adjacent sidewalls. A clamp presses the adjacent sidewalls and the support plate together in a juxtaposed laminar arrangement.

In yet another aspect of the present invention, a method of assembly comprising steps of providing a laterally-extending tubular support, providing an armrest having a tubular end, and telescopingly engaging the tubular end into the tubular support, with the tubular end having a first sidewall adjacent a similarly-shaped sidewall of the tubular support. The method further includes providing a clamp having a fastener and a clamp handle, passing the fastener completely through top walls of the tubular support and the tubular end, and extending the fastener through the first sidewall and through the similarly-shaped sidewall, and attaching the clamp handle to an end of the fastener. The method further includes operating the clamp to press the adjacent sidewalls together without crushing other walls of the tubular support and the tubular end, such that remaining walls of the tubular support and the tubular end are not stressed in a way that will deform them even when the clamp is clampingly pressing the adjacent sidewalls together.

In another aspect of the present invention, an adjustable back arrangement includes a back upright having a bearing, a back slidably engaging the back upright for movement between different height positions, and a latch member for securing the back in a selected one of the different height positions. The back includes a back shell defining a pivotal support. One of the bearing and the upright include a row of notches. The latch member pivotally engages the pivotal support and includes a locking tooth for selectively engaging the notches as the back is moved between the different height positions.

In still another aspect of the present invention, a seat component is provided for a seating unit. The seat component has a shell with a top surface and a bottom surface, and has front, side and rear edges. The top surface and front edge are configured to support a seated user with the front edge being curved forwardly and downwardly and adapted to comfortably support a seated user's legs hanging over the front edge. The side edges of the shell extend from ends of the front edge and each define a downwardly-facing concavity. An upholstery component includes a perimeter and an edge-mounted drawstring extending at least partially around the perimeter. The upholstery component covers the top surface with perimeter edge portions extending around the front, side and rear edges and extending onto the bottom surface in a manner placing the edge-mounted drawstring under the shell and across the concavities of the sides. The drawstring is tensioned and holds the upholstery on the shell. The shell includes outwardly-extending fingers that retain the drawstring against the bottom surface of the shell even in areas of the concavities to improve appearance and assemble-ability, such that the drawstring does not extend linearly across the concavities.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
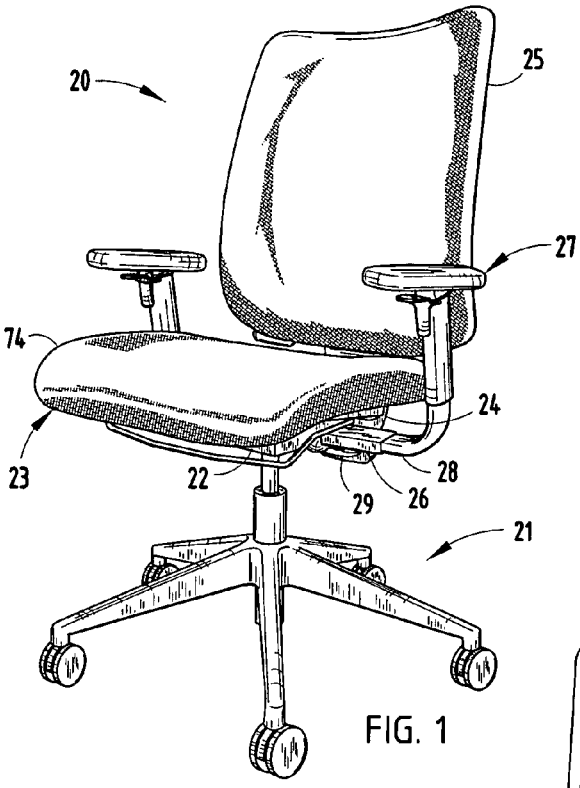
FIGS. 1-3 are perspective, side, and rear views of a chair embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A synchrotilt seating unit 20 (FIGS. 1-3) includes a base 21 with a control 22, a seat 23 operably supported on the control 22, and a reclinable back 25 supported by an upright 24 extending from a rear of the control 22. A laterally-extending fixed tubular support 26 extends from the control 22 to a position near a side edge of the seat 23. An armrest 27 on each side includes a tubular end 28 telescopingly engaging the tubular support 26 for lateral adjustment, and includes a clamping mechanism 29 for clamping the armrest 27 in a selected laterally adjusted position.

Figure 4:
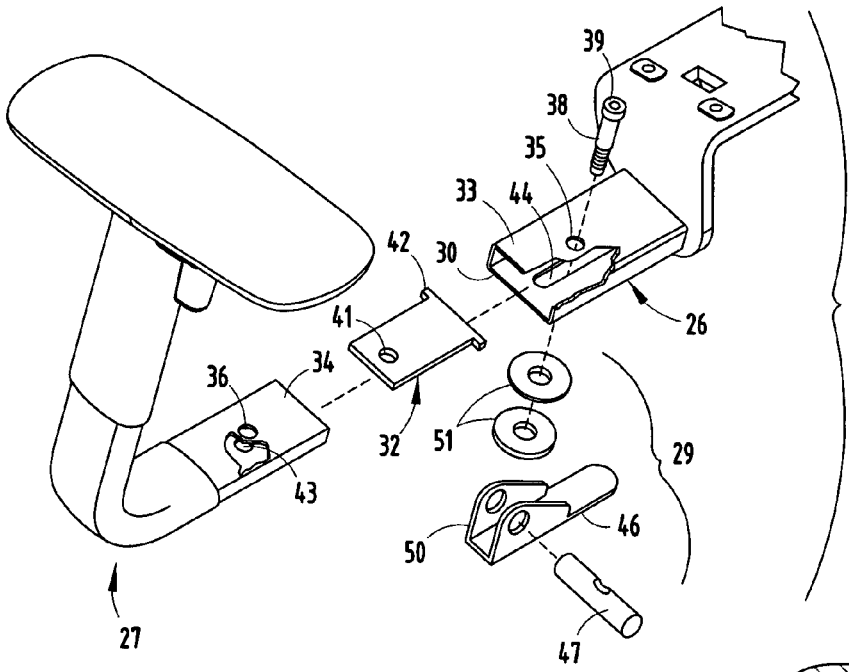
FIG. 4 is an exploded perspective view of the armrest and supporting adjustment structure.
Figure 5:
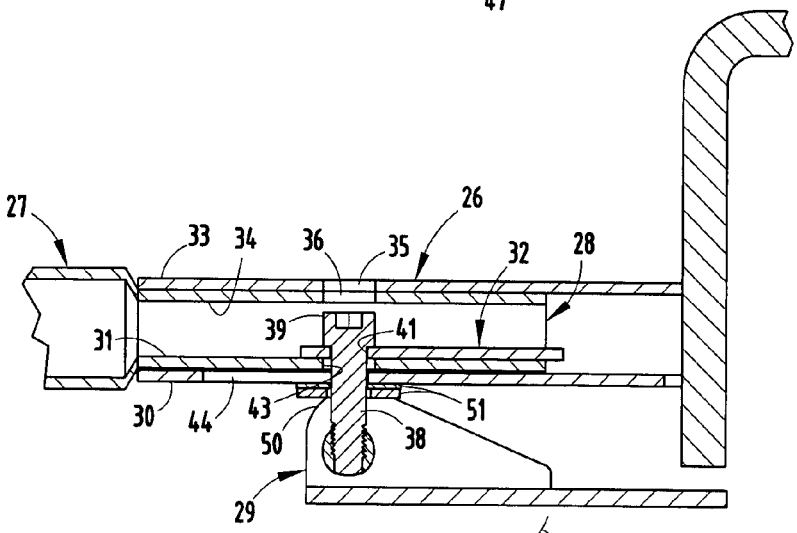
FIG. 5 is a cross sectional view of the armrest and supporting adjustment structure.
Figure 6:
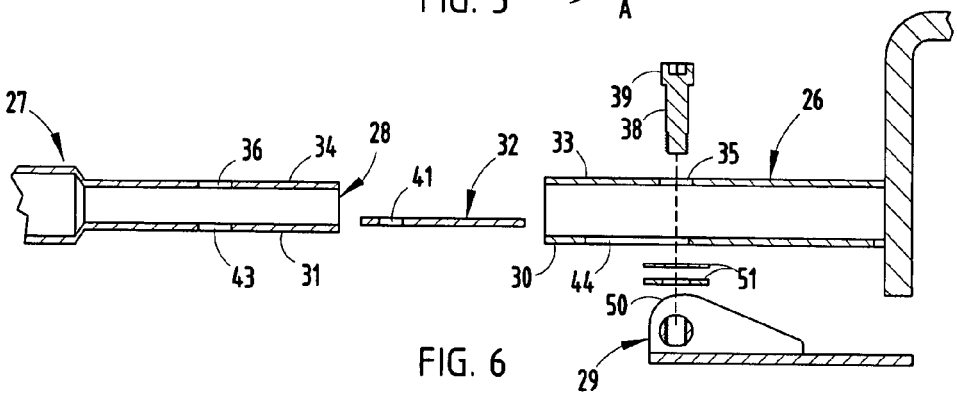
FIG. 6 is an exploded view of FIG. 5.

The illustrated tubular support 26 and tubular end 28 (FIGS. 4-6) are rectangularly shaped for mating (non-rotational) engagement, with their bottom walls 30 and 31 abutting and positioned adjacently. A stiff support plate 32 is positioned on a top of the bottom wall 30 of the tubular support 26. The top walls 33 and 34 of the tubular support 26 and tubular end 28 include aligned top holes 35 and 36. The clamping mechanism 29 includes a bolt 38 with a head 39 configured to slip through the aligned top holes 35 and 36. The support plate 32 is configured to fit into an inside of the tubular end 28, and includes a hole 41 and further includes ears 42 that abut an outer end of the tubular end 28 for positioning the hole 41 under the aligned holes 35 and 36. The bottom wall 31 includes a hole 43 aligned with the hole 36. Hole 41 in support plate 32 has a slightly smaller diameter than hole 36 so that the bolt head 39 cannot slip through it. This arrangement facilitates assembly, but maintains components in hidden positions for aesthetics.

A longitudinally-extending slot 44 in the bottom wall 30 aligns generally with the holes 35-36 and 41. A clamping handle 46 carries a barrel nut 47 threadably engages the shaft of the bolt 38. The handle 46 is rotatable on the barrel nut 47 and is rotatable between a clamping position (FIG. 5) where camming surfaces 50 on the handle 46 abut washers 51 located against a bottom surface of the bottom wall 30 and tension the bolt 38. This pulls the support plate 32 against the adjacent walls 30 and 31, clamping them together in a secure juxtaposed laminar arrangement. The handle 46 is rotatable in direction "A" (FIG. 5) to a second position where the camming surfaces 50 disengage and release the bolt 38 from tension. By this arrangement, remaining walls of the tubular support 26 and the tubular end 28 are not stressed and deformed to a less-uniform rectangular tubular shape, even when the clamping mechanism 29 is clampingly pressing the adjacent sidewall sections together, since the support plate 32 and adjacent walls 30 and 31 are flat against each other. Also, the armrest is easily laterally adjustable relative to the seat since the armrest can be released, adjusted by sliding the armrest outwardly (i.e., the bolt 38 sliding along the slot 44 to allow the extension and adjustment) and re-secured. The washers 51 help by providing a consistent and smooth sliding adjustment motion.

Figure 2:
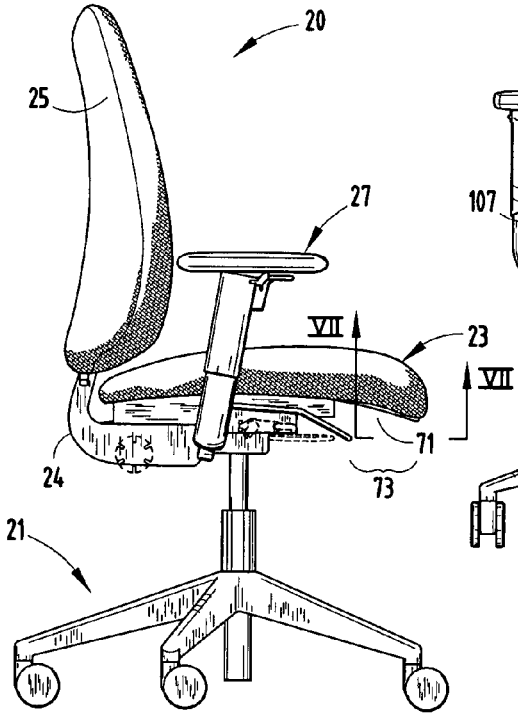
Figure 3:
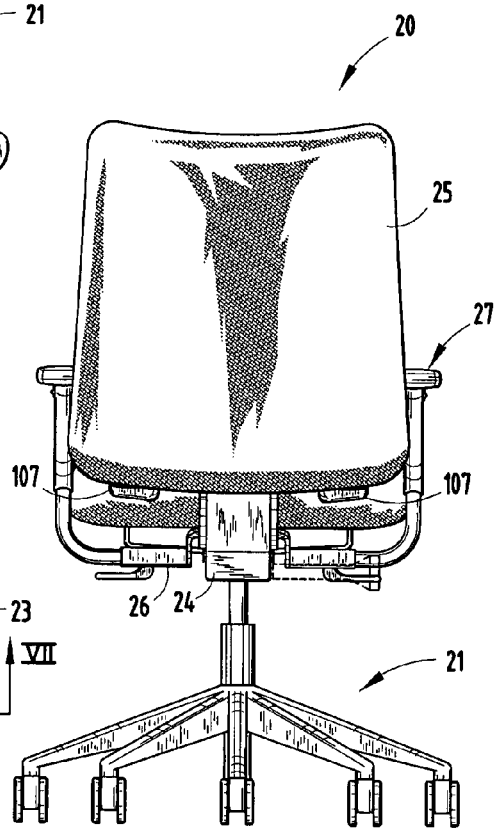
Figure 7:
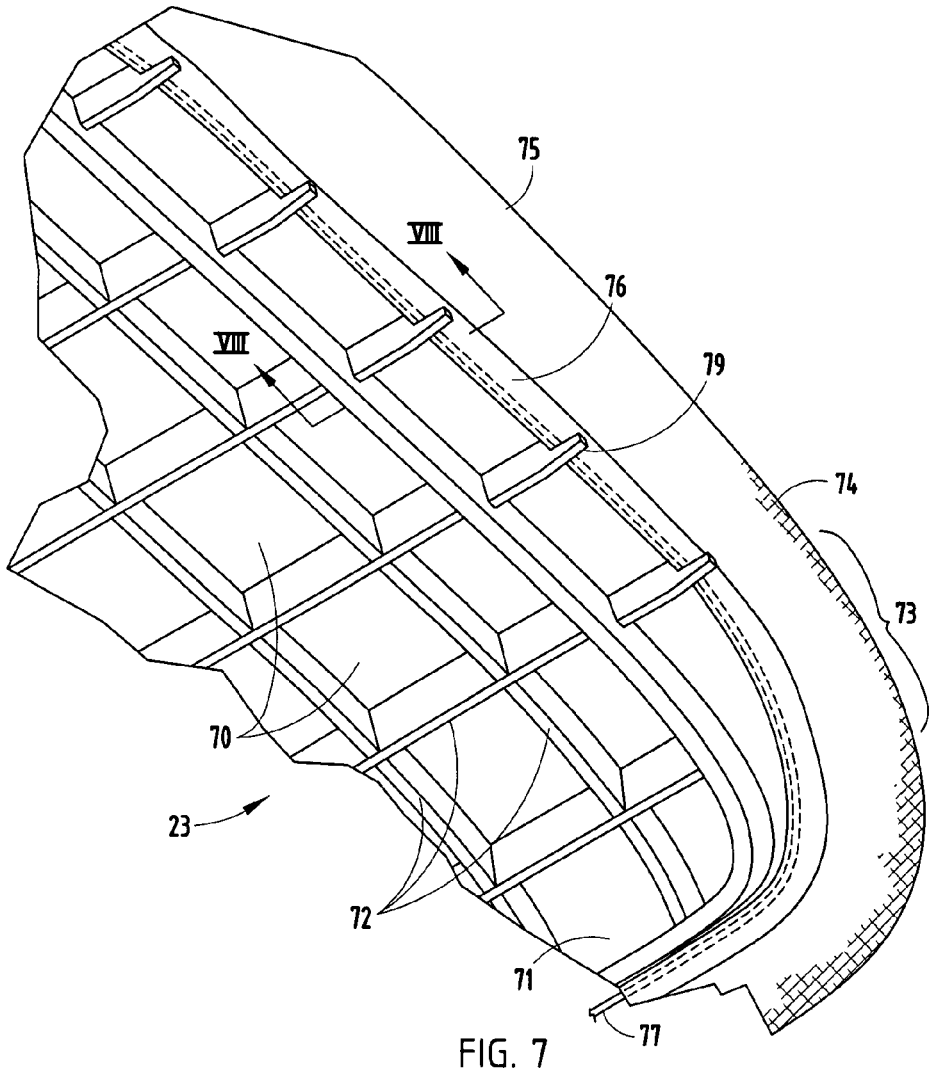
FIG. 7 is a bottom perspective view of the front under-seat structure in the direction of arrow VII in FIG. 2.
Figure 8:
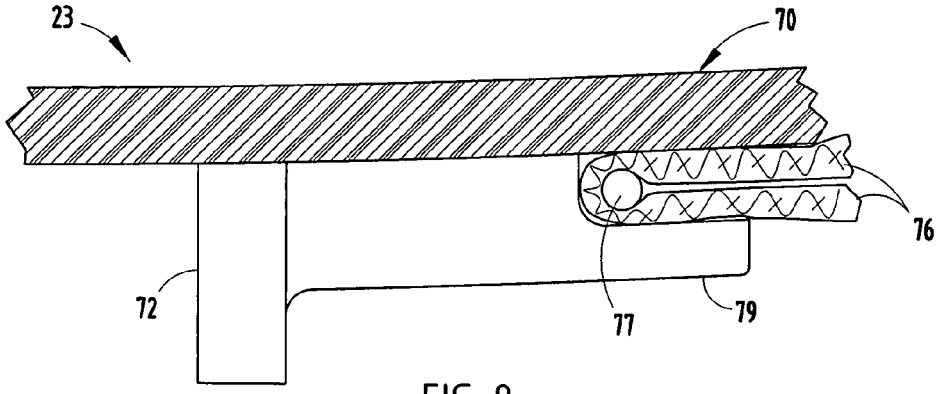
FIG. 8 is a cross section taken along the line VIII-VIII in FIG. 7.
Figure 9:
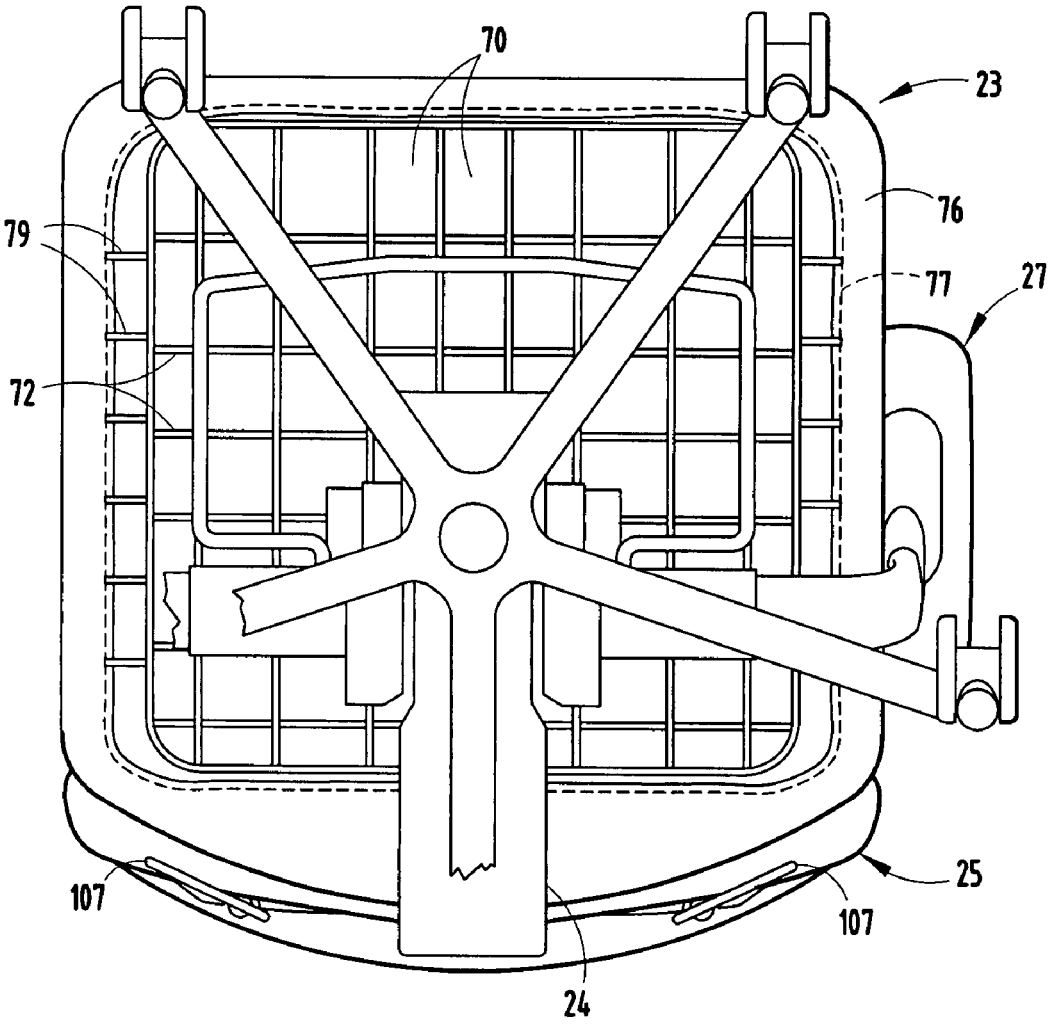
FIG. 9 is a bottom view showing a bottom of the seat of the chair.

It is noted that the next concept is shown as a seat component in FIGS. 2 and 7-8, but it is noted that the same concept can be used on a back or other furniture component, where an edge of an upholstery assembly must be secured against a concave surface.

The illustrated seat 23 (FIGS. 7-8) has a polymeric shell 70 with a top surface shaped for supporting a seated user, a bottom surface with stiffening ribs 72, and has front, side and rear edges. The top surface and front edge are configured to support a seated user with the front edge section 73 being curved forwardly and downwardly in a "waterfall" shape adapted to comfortably support a seated user's legs hanging over the front edge 73. Each side edge 74 of the shell 70 extends rearwardly from the end of the front edge and each defines a downwardly-facing concavity 71. The concavity 71 has a greatest depth at about 2 to 5 inches rearward of a front of the seat 23 and tapers from there to the rear of the seat 23. If upholstery was placed on the seat 23 and wrapped around onto a bottom of the shell 70 and attached solely by a tensioned drawstring, the upholstery would trace a straight line from front to rear under the shell 70, resulting in the seat 23 looking much thicker (vertically) than it actually is because the drawstring would bridge linearly across the concavity 71. In some chair designs, designers do not want this thick "bridge" condition.

The present seat 23 solves that problem. The seat 23 (FIGS. 7-8) includes a top cushion (not shown) and an upholstery cover 75. The upholstery cover 75 includes a perimeter strip 76 doubled back to form a tunnel, and an edge-mounted drawstring 77 extending at least partially around a perimeter of the cover 75 through the tunnel. The upholstery cover 75 drapes over the top surface of the seat 23 with edge portions of the cover 75 extending around and under the front, side and rear edges of the seat 23. This places the edge-mounted drawstring 77 under the shell and across the concavities 71 on each side of the shell 70. The tensioned drawstring 77 holds the upholstery cover 75 on the shell 70. The shell 70 further includes a plurality of spaced-apart outwardly extending fingers 79 that retain the drawstring 77 adjacent and against the bottom of the shell 70 even in areas of the concavities 71. This is done to improve appearance and improve assemble-ability. The fingers 79 can be located as desired, as close together or a far apart as desired, and across the entire side edges of the chair or only partially along each side. As noted above, the present concept of retaining fingers positioned to hold a tensioned drawstring can also be used on other components such as a chair back. It is noted that a back constructed in this manner would have the drawstring and fingers exposed, unless it would be covered with a cover panel or the like.

Figure 10:
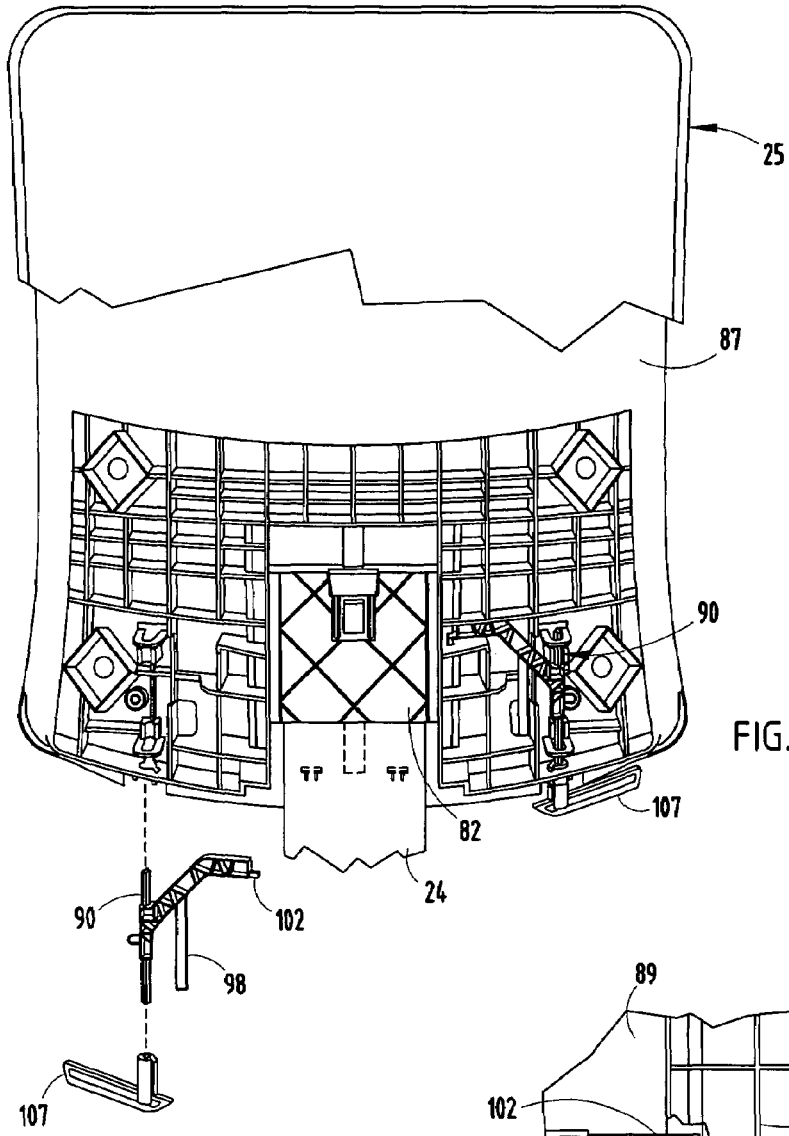
FIGS. 10-11 are rear views of the back of the chair shown in FIG. 1, with the upholstery covering being partially broken away to better show the back adjustment mechanism and with various components of the back adjustment mechanism being exploded apart to better show other components.
Figure 12:
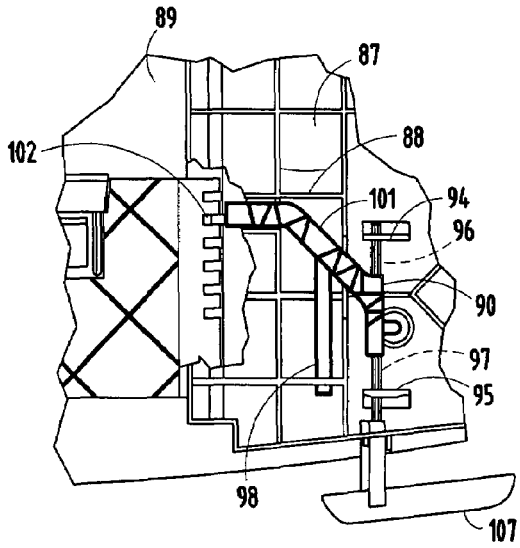
FIG. 12 is an enlarged partial view of the assembled back adjustment mechanism.
Figure 11:
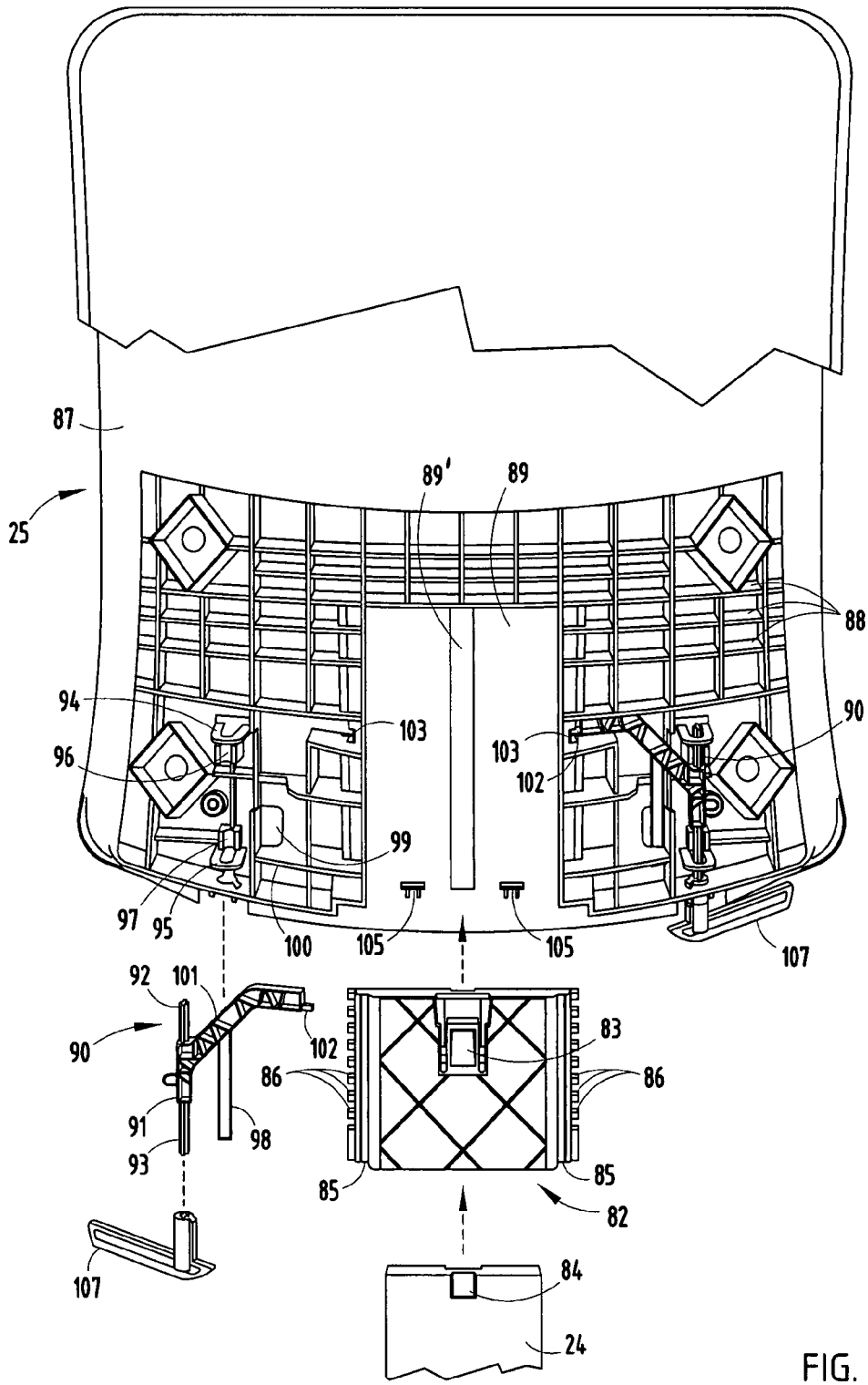

The components of the mechanism for permitting vertical adjustment of the back 25 are shown in FIGS. 10-12. As noted above, the back 25 is supported by an upright 24 (FIG. 2). A bearing 82 (FIG. 11) is configured to slip onto a top of the upright 24, and includes a resilient tine 83 that engages a notch 84 for retaining the bearing 82 on the upright 24. The bearing 82 includes linear edge flanges 85 on each side forming bearing surfaces, and further each flange includes a plurality of notches 86 along their outer edge. The back 25 includes a back shell 87 with reinforcement ribs 88 and an elongated pocket 89 formed to slidably receive the bearing 82. A center ridge 89' helps maintain the bearing 82 in accurate alignment for smooth adjustment. The ribs adjacent the pocket 89 are particularly formed to support a latch member 90 on each side. The latch member 90 includes an axle 91 with first and second ends 92 and 93 that fit under retainer loops 94 and 95 (first one end and then the other during assembly) and that rotatably engage semi-cylindrical bearing supports 96 and 97. The latch member 90 further includes a resilient leg 98 that fits into an aperture 99 under a rib 100. The resilient leg 98 acts as a spring to bias the latch member to a normally engaged locking position. The latch member 90 further includes a stiff leg 101 having a locking tooth 102 at its outer end. The locking tooth 102 fits into a notch 103 in rib adjacent the pocket 89, as a location where the locking tooth 102 will selectively engage one (or more) of the notches 86 on the bearing 82. Stops 105 on the back shell 87 permit assembly of the bearing 82 into the pocket 89, but engage ribs on the bearing 82 to prevent the back 25 from separating and coming off of the bearing 82. A handle 107 engages a lower end of the axle 91, which places the handle 107 below and adjacent a lower edge of the back 25 (FIG. 3) in a location where it is easily grasped and operated by a seated user. For example, the seated user reaches behind the chair at a bottom of the back 25 to find the handles 107. Then, the user both rotates and pulls the handles 107 to lift the back 25 (or drop by gravity) in order to vertically adjust a height of the back 25. It is contemplated that different handles can be used, but the present handle combines with the latch member 90 to provide a very simple, low cost, easily operated, and easily assembled system.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A seat component for a seating unit comprising:

a shell with a top surface and a bottom surface, and having front, side and rear edges; the top surface and front edge being configured to support a seated user with the front edge being curved forwardly and downwardly and being adapted to comfortably support a seated user's legs as the user's legs extend over the front edge, the side edges of the shell extending from ends of the front edge and each defining a downwardly-facing concavity; and an upholstery component including a perimeter and an edge-mounted drawstring extending at least partially around the perimeter, the upholstery component covering the top surface with perimeter edge portions extending around the front, side and rear edges and extending onto the bottom surface in a manner placing the edge-mounted drawstring under the shell and across the concavities of the sides, the drawstring being tensioned and holding the upholstery on the shell, the shell including retaining fingers that retain the drawstring against the bottom surface of the shell even in areas of the concavities to improve appearance and assemble-ability, such that the drawstring does not bridge linearly across the concavities.

2. The seat component defined in claim 1, wherein the fingers define notches adjacent the bottom surface along non-linear perimeter portions of the bottom surface.

3. The seat component defined in claim 1, wherein the fingers include a bottom surface that is about equal in height with the reinforcement ribs.

4. The seat component defined in claim 1, wherein the fingers are spaced apart and are located at least along the front edge as well as the side edges.

5. The seat component defined in claim 4, wherein the fingers are also positioned along the rear edge.

6. A furniture component for a seating unit, comprising:

a molded shell with a support surface and a hidden surface, and having front, side and rear edges; the support surface being configured to support a user with at least one of the front, rear, and side edges being curved to define a concavity on the hidden surface; and a cover including a perimeter and an edge-mounted drawstring extending at least partially around the perimeter, the cover covering the support surface with perimeter edge portions extending around the front, side and rear edges and extending onto the hidden surface in a manner placing the edge-mounted drawstring under the shell and across the at least one concavity, the drawstring being tensioned and holding the cover on the shell, the shell including spaced-apart retaining fingers that are positioned along an entire length of at least one of the front, rear and side edges to retain the drawstring against the hidden surface of the shell even in areas of the concavity to improve appearance and assemble-ability, such that the drawstring does not bridge linearly across the concavity.

7. The furniture component defined in claim 6, wherein the fingers are positioned along an entire length of at least two adjacent ones of the front, rear, and side edges.

8. A method of assembling a seating unit comprising:

providing a shell with a top surface and a bottom surface, and having front, side and rear edges; the top surface and front edge being configured to support a seated user with the front edge being curved forwardly and downwardly and being adapted to comfortably support a seated user's legs as the user's legs extend over the front edge, the side edges of the shell extending from ends of the front edge and each defining a downwardly-facing concavity, the shell further having a matrix of downwardly-extending reinforcement ribs;

providing an upholstery component including a perimeter and an edge-mounted drawstring extending at least partially around the perimeter;

covering the top surface of the shell with the upholstery component perimeter extending around the front, side and rear edges;

placing the edge-mounted drawstring under the shell and across the concavities of the sides; and tensioning the drawstring to hold the upholstery on the shell, wherein the shell includes retaining fingers that extend from the reinforcement ribs and that retain the drawstring against the bottom surface of the shell, such that the drawstring does not bridge linearly across the concavities.

9. The method defined in claim 8, wherein the tensioning step includes providing the fingers to define notches adjacent the bottom surface along non-linear perimeter portions of the bottom surface.

10. The method defined in claim 8, wherein the step of providing the shell includes providing the reinforcement ribs with a continuous rib extending parallel the side edge but is located inboard of the perimeter.

11. The method defined in claim 8, wherein the step of providing the shell includes providing the fingers with a bottom surface that is about equal in height with the reinforcement ribs.

12. The method defined in claim 8, wherein the tensioning step includes providing fingers that are spaced apart and are located at least along the front edge as well as the side edges.

13. The method defined in claim 12, wherein the tensioning step includes providing fingers that are also positioned along the rear edge.

14. A seat component for a seating unit, comprising:

a shell with a top surface and a bottom surface, and having front, side and rear edges; the top surface and front edge being configured to support a seated user with the front edge being curved forwardly and downwardly and being adapted to comfortably support a seated user's legs as the user's legs extend over the front edge, the side edges of the shell extending from ends of the front edge and each defining a downwardly-facing concavity; and an upholstery component including a perimeter and an edge-mounted drawstring extending at least partially around the perimeter, the upholstery component covering the top surface with perimeter edge portions extending around the front, side and rear edges and extending onto the bottom surface in a manner placing the edge-mounted drawstring under the shell and across the concavities of the sides, the drawstring being tensioned and holding the upholstery on the shell, the shell including retaining fingers that retain the drawstring against the bottom surface of the shell even in areas of the concavities to improve appearance and assemble-ability, such that the drawstring does not bridge linearly across the concavities, wherein the shell includes a matrix of downwardly-extending reinforcement ribs and the fingers extend from the reinforcement ribs, and wherein the reinforcement ribs include a continuous rib extending parallel the side edge but is located inboard of the perimeter.

15. The seat component defined in claim 14, wherein the fingers include a bottom surface that is about equal in height with the reinforcement ribs.

16. The seat component defined in claim 15, wherein the fingers are spaced apart and are located at least along the front edge as well as the side edges.

17. A furniture component for a seating unit, comprising:

a molded shell with a support surface and a hidden surface, and having front, side and rear edges; the support surface being configured to support a user with at least one of the front, rear, and side edges being curved to define a concavity on the hidden surface; and a cover including a perimeter and an edge-mounted drawstring extending at least partially around the perimeter, the cover covering the support surface with perimeter edge portions extending around the front, side and rear edges and extending onto the hidden surface in a manner placing the edge-mounted drawstring under the shell and across the at least one concavity, the drawstring being tensioned and holding the cover on the shell, the shell including spaced-apart retaining fingers that are positioned along an entire length of at least one of the front, rear and side edges to retain the drawstring against the hidden surface of the shell even in areas of the concavity to improve appearance and assemble-ability, such that the drawstring does not bridge linearly across the concavity, wherein the shell includes a matrix of downwardly-extending reinforcement ribs, and the fingers extend from the reinforcement ribs.

18. The furniture component defined in claim 17, wherein the reinforcement ribs include a continuous rib extending parallel the side edge but is located inboard of the perimeter.

19. The furniture component defined in claim 17, wherein the fingers include a bottom surface that is about equal in height with the reinforcement ribs.

* * * * *